United States Patent [19]

Sandström

[11] Patent Number: 4,799,281

[45] Date of Patent: Jan. 24, 1989

[54] DEVICE FOR SWEEPER UNITS

[76] Inventor: Henry Sandström, 11, Vimpelgatan,, S-591 00 Motala, Sweden

[21] Appl. No.: 123,214

[22] Filed: Nov. 20, 1987

[30] Foreign Application Priority Data

Dec. 18, 1986 [SE] Sweden ..... 8605464

[51] Int. Cl.[4] ..... E01H 1/04

[52] U.S. Cl. ..... 15/80; 56/328.1

[58] Field of Search ..... 15/51, 80, 84, 99; 56/328 R

[56] References Cited

U.S. PATENT DOCUMENTS 684,618 10/1901 Schmidt ..... 15/80

1,236,841 8/1917 Holdren ..... 15/84

FOREIGN PATENT DOCUMENTS 1407614 9/1975 United Kingdom ..... 15/84

*Primary Examiner*—Edward L. Roberts

*Attorney, Agent, or Firm*—Dowell & Dowell

[57] ABSTRACT

A conveying mechanism for sweeping debris from a surface and which includes a chute having a lower edge spaced from the surface and along which the debris is moved by an endless carrier having a plurality of spaced sweeper or broom members. An endless flexible sheet material extends vertically from the chute into contact with the surface to be swept and upwardly therefrom along the chute so as to prevent debris from being urged forwardly of the chute and further cooperates with the endless carrier to transport debris along the chute to a collection receptacle.

11 Claims, 1 Drawing Sheet

10
12
14
15
16
17
18
19
20
22
24
26
28
30
32
34
36
38
40
42
44

DEVICE FOR SWEEPER UNITS

BACKGROUND OF THE INVENTION

1. Field of the Invention

The present invention relates to a device for street sweeper units of the type which include an elevator having an inclined chute along which an endless carrier is mounted so as to transport refuse or debris and the like upwards from the lower end of the chute to the upper end thereof.

The endless carrier of the elevator usually includes a series of brooms that alternately bear against the ground and sweep refuse and debris in the direction of travel of the sweeper unit and carry the debris along the chute and upwards to a collecting vessel which is located adjacent the upper edge of the chute. The lower transverse edge of the chute is necessarily located in spaced vertical relationship above the ground or surface to be swept in order to prevent the lower edge of the chute from striking against irregularities along the surface.

2. History of the Related Art

A problem associated with prior sweeper units is that some portion of the refuse is thrown forward by the brooms mounted to the carrier elements with the debris passing between the lower transverse edge of the chute and the surface to be swept. Thus, in some instances, the brooms do not convey the debris into the chute. In order to solve this problem, it is known to mount, adjacent the lower tranverse edge of the chute, a freely rotatable sweeping roll which is intended to bridge or extend across the space between the transverse edge and the surface to be swept. In this way, the sweeping roller guides the refuse or debris up into the chute in cooperation with the carrier and broom elements of the elevator so that the lower edge of the chute can be spaced at a sufficiently great distance from the ground or surface being swept so as to prevent it from being damaged when the sweeper unit is advanced relative to such surface. However, even with these known devices, the distance between the lowermost edge of the chute and the surface to be swept may be varied depending upon the contour of the ground or surface and further, such sweeping rollers may become worn after a period of use thereby allowing a space to again be created between the surface and the lower edge of the chute.

OBJECT OF THE INVENTION

The main object of the present invention is to produce a device for sweeper units of the kind described above which eliminates the stated problem and in this respect presents a manner of preventing debris from being moved in a space between the surface being swept and the lower edge of the chute and which does so in such a manner that vertical variances and distance between the lower edge of the chute and the surface to be swept are compensated for. This object is obtained, according to the invention, by utilizing a flexible barrier of sheet material which extends along the chute and downwardly into engagement with the ground forwardly of the chute. The flexible sheet is preferably formed in a continuous or endless belt configuration which may be driven relative to the chute by frictional engagement of the flexible material with the broom elements mounted to the endless carrier. Further, in other embodiments, the sheet material may be provided with transverse flanges which cooperate with the broom or sweeper elements to elevate debris or refuse along the chute to a collection receptacle.

DESCRIPTION OF THE PREFERRED EMBODIMENT

Figures 1, 2:
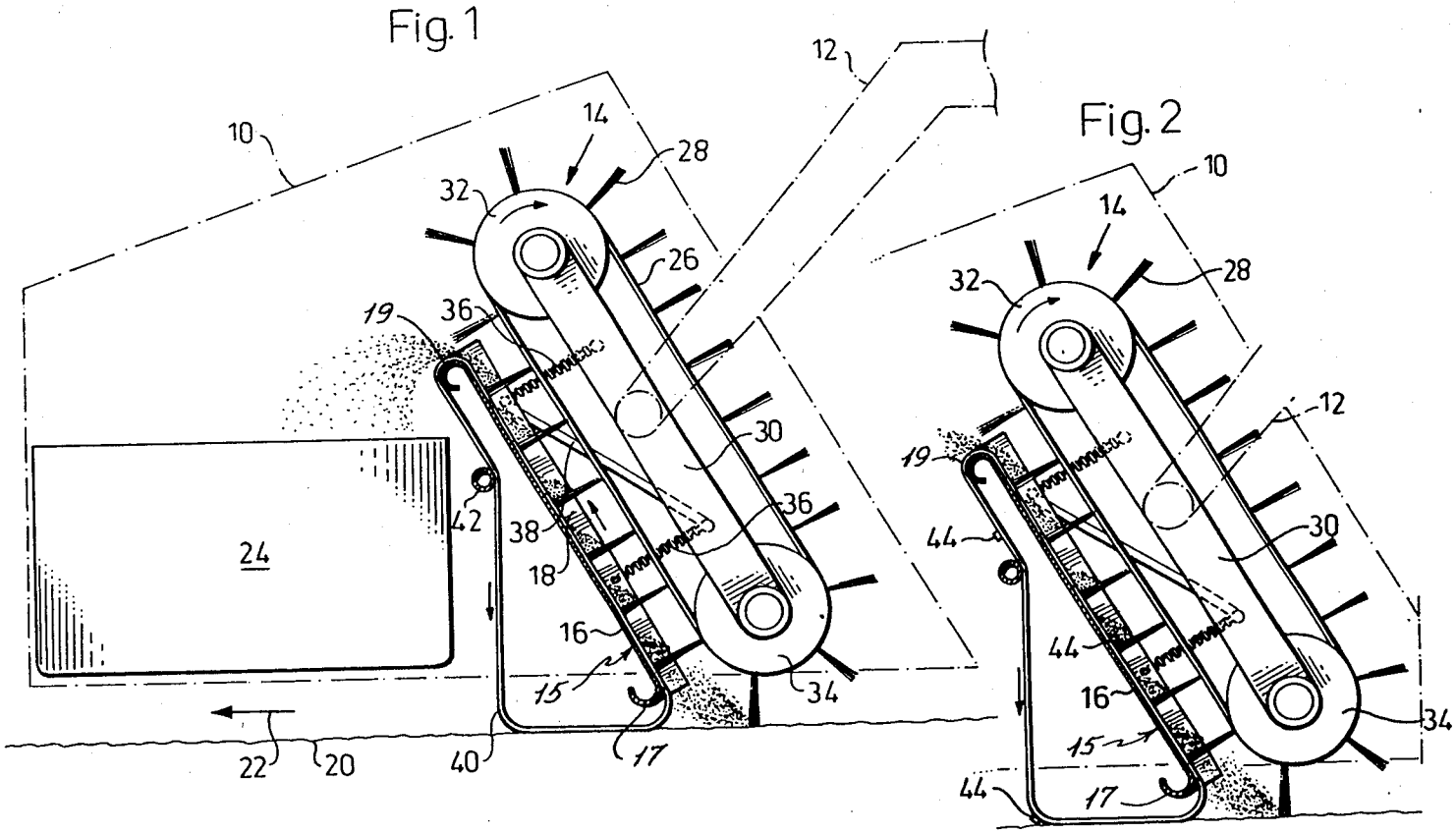
FIG. 1 shows a partial cross sectional and illustrational view of a first embodiment of the invention with the sweeper being connected to a lift unit shown in dotted line
FIG. 2 is a view similar to that of FIG. 1 of a modified embodiment of the invention.

With continued reference to the drawings, there is indicated in FIGS. 1 and 2 with dotted lines a sweeper unit 10 which may be supported by support arms 12 also shown in dotted lines on a tractor or similar machine (not shown). The sweeper unit 10 is of a conventional construction having rotating brooms (not shown) which sweep refuse on the ground into a windrow so as to be properly positioned for receipt into the elevator 14 of the sweeper unit as will be described in greater detail. Such a sweeper unit is shown, for example in Swedish patent specification No. 335,747 to which reference is made for a more general description of the function of the sweeper unit and the rotating brooms.

The sweeper unit comprises a chute 15 having a flat bottom 16 and upraised side edges 18. The chute is installed within the unit 10 so that it extends from a lower transverse edge 17 which, as shown in a use position, is elevated at some distance above the ground level 20. The ground or surface will be swept in the direction of travel of the unit which is indicated by the arrow 22. The upper end 19 of the chute 15 is positioned adjacent to a collecting vessel 24 disposed in the unit 10 and which receives refuse dropped from the upper transverse edge or upper end 19 of the chute.

The transport of debris or refuse along the chute is accomplished by an elevator mechanism 14 which comprises an endless belt 26 to which a plurality of sweeper elements or brooms 28 are disposed at spaced intervals. The belt 26 is carried by a pair of turning rollers 32 and 34 journaled adjacent the ends of the chute on a frame 30. The upper roller 32 is driven by a motor (not shown) such as a hydraulic motor. The chute 16 is supported on the frame 30 of the elevator by means of two supporting members 36 which preferably are resilient so as to cause the chute 15 to be tensioned with a predetermined force in a direction towards the frame 30 of the elevator. A bar 38 is fixed in between the frame 30 and each of the side edges of the chute 16 in order to stabilize the chute in its longitudinal direction.

Due to the resilient supporting of the chute 15 and the elevator 14 in relation to each other, the carriers or brooms 28 will remain in contact with the bottom of the chute 15 even when the brooms 28 become worn from use.

The above described elevator device 14 operates, as has been mentioned, in such a manner that debris or refuse encountered when the sweeper moves in the direction of travel 22 is swept into the chute and transported by the brooms to the upper transverse edge of the chute where the refuse or debris falls into the collection vessel 24. In order to bridge or cover the area or space between the lower transverse edge of the chute 15 and the ground surface 20, the present invention includes a soft flexible sheeting material 40 which runs in an endless loop over the bottom 16 of the chute and substantially covers the chute. The sheeting extends from the upper transverse edge in a downward direction towards engagement with the ground 20 against the ground and thereafter extends upwardly to the lower transverse edge of the chute and along the bottom of the chute. As mentioned, the sheeting is preferably formed of a soft flexible pliable material such as rubber, or rubber-like plastic. The sheeting is positioned loosely over the bottom of the chute and is guided around the lower transverse edge by rounding the transverse edge of the chute into a soft radius or curve. In order to locate the upper transverse edge of the chute above the collection vessel 24, the sheet material 40 is conducted over a fixed guide member 42 which may be embodied in a transverse rod or the like mounted rearwardly of and below the upper transverse edge of the chute.

The sheet material 40 is moved by the carriers or brooms 28 of the elevator 14 by the frictional engagement of the carriers or brooms with the sheet material. The sheeting moves in the direction of the transport of the refuse as indicated by the arrows in FIG. 1. The sheet material 40 covers the space between the lower transverse edge of the chute and the ground 20 and thus prevents refuse from being moved in the direction of sweep and ahead of the chute. Therefore, the refuse is directed towards the chute and retained between the sheet material and the brooms which transport the material upwardly to the discharge from the upper transverse edge and into the collection receptacle.

In the embodiment according to FIG. 2, the parts in common with the embodiment of FIG. 1 have been numbered with the same reference numerals. In this embodiment, the sheeting 40 has been provided with transverse flanges or projections 44 which further insure that the sheet material 40 is conveyed by the brooms 28 over the bottom 16 of the chute In this embodiment, the projections 44 which engage the carrier or brooms 28 of the elevator 14 need only be positioned with such spacing that a new projection 44 will engage a broom 28 at the lower transverse edge of the chute simultaneously as preceding projection 44 passes over the upper transverse edge of the chute. Projections 44 may be positioned more densely if required.

It becomes evident from the aforesaid that the sweeper unit made in accordance with the present invention having a soft sheet material which bridges the space between the lower edge of the chute of the elevator 14 and the ground 20 accomplishes the object stated above with respect to preventing material from moving forwardly of the chute during a sweeping operation. Because the sheeting 40 is soft and pliable and in unstressed position lies loosely over a considerable portion of the ground surface 20, the sheet material is independent of the dimension of the spacing between the chute and the ground as well as compensates for surface irregularities in the ground. Refuse cannot pass beyond the lower transverse edge of the chute in the direction of travel 22 but positively engages the sheet material and is carried along the same together with the action of the brooms 28 of the elevator upwardly of the chute to the discharge end thereof.

Obviously, the invention is not limited to the embodiments shown and described but may be varied in a plurality of aspects and still be within the scope of the basic invention.

I claim:

1. In a sweeper having an elevating mechanism including a chute which is inclined upwardly from a lower edge to an upper edge in the direction of travel of the sweeper and which along the upper surface thereof debris is transported by an endless carrier and wherein a space is created between the lower edge of the chute and the surface to be swept the improvement comprising, an endless flexible sheet means, said sheet means extending forwardly of said endless carrier in the direction of travel of the sweeper and being in contact with the surface to be swept, said sheet means extending upwardly from the surface to be swept through the space between the lower edge of the chute and along the upper surface of the chute, said endless carrier including a plurality of sweeper elements, said sheet means extending between said sweeper elements and the upper surface of the chute and over the upper edge of the chute and downwardly thereof to the surface to be swept, drive means for moving said endless carrier relative to said upper surface of the chute, said sweeper elements being engageable with the surface to be swept as said endless carrier is moved by said drive means, whereby said flexible sheet means prevents debris from being urged forwardly of the lower edge of the chute as said endless carrier is moved by said drive means.

2. The sweeper of claim 1 in which a portion of said flexible sheet means extends in generally parallel relationship and in engagement with the surface to be swept whereby said flexible sheet means may be extended vertically so as to compensate for differences in vertical spacing between the lower edge of the chute and the surface to be swept.

3. The sweeper of claim 2 in which said sweeper elements of said endless carrier frictionally engage said flexible sheet means along the upper surface of the chute, said flexible sheet means being movable with respect to the chute by said sweeper elements.

4. The sweeper of claim 3 including resilient mounting means for mounting said endless carrier relative to the upper surface of the chute, said resilient mounting means normally urging said sweeper elements toward said flexible sheet means.

5. The sweeper of claim 4 in which said sweeper elements are brooms, said brooms being generally equally spaced along said endless carrier and extending outwardly therefrom.

6. The sweeper of claim 5 in which said flexible sheet means has opposite edge portions, at least two spaced flange members mounted to the flexible sheet means and extending between said opposite edge portions, said flange members being in opposing relationship to said brooms and being engageable by said brooms.

7. The sweeper of claim 1 in which said sweeper elements of said endless carrier frictionally engage the flexible sheet means along the upper surface of the chute, said flexible sheet means being movable with respect to the chute by said sweeper elements.

8. The sweeper of claim 7 including resilient mounting means for mounting said endless carrier relative to the upper surface of the chute, said resilient mounting means normally urging said sweeper elements toward said flexible sheet means.

9. The sweeper of claim 8 in which said flexible sheet means includes opposite edge portions, at least two flange members mounted to the flexible sheet means and extending between said opposite edge portions, said flange members being generally equally spaced along said sheet means and extending in opposing relationship to said sweeper elements and being engageable by said sweeper elements.

10. The sweeper of claim 9 in which said sweeper elements are brooms, said brooms being generally equally spaced along said endless carrier.

11. The sweeper of claim 1 including guide means mounted below the upper edge of the chute, said guide means being positioned rearwardly of said upper edge of the chute relative to the direction of travel of the sweeper, said flexible sheet means depending vertically from said guide means into contact with the surface to be swept and a portion of said flexible sheet means extending generally parallel with and in contact with the surface to be swept.

* * * * *